US005938195A

United States Patent [19]

Anghelo et al.

[11] Patent Number: 5,938,195

[45] Date of Patent: Aug. 17, 1999

[54] SERPENTINE RAMP FOR A PINBALL GAME

[75] Inventors: Python Anghelo, Chicago; Raymond Czajaka, Hometown; Dan K. P. Lee, Skokie, all of Ill.

[73] Assignee: Williams Electronics Games Inc., Chicago, Ill.

[21] Appl. No.: 08/164,058

[22] Filed: Dec. 8, 1993

(Under 37 CFR 1.47)

[51] Int. Cl.[6] ..... A63F 7/30

[52] U.S. Cl. ..... 273/127 D; 273/127 R; 273/118 R; 273/118 A; 273/119 R; 273/119 A; 273/121 R; 273/121 A; 273/110; 273/112

[58] Field of Search ..... 273/108, 110, 273/112, 118, 119, 121, 127 R, 127 D; 446/168

[56] References Cited

U.S. PATENT DOCUMENTS 3,100,946 8/1963 Swanberg et al. ..... 446/168 X
4,290,605 9/1981 Matsumoto ..... 273/110
4,934,699 6/1990 Kaminkow et al. ..... 273/121 A
4,968,031 11/1990 Kaminkow et al. ..... 273/127 D
5,120,059 6/1992 Oursler .
5,335,910 8/1994 Tanzer et al. ..... 73/121 A
5,358,240 10/1994 Lawlor et al. .
5,358,241 10/1994 Anghelo et al. .

*Primary Examiner*—Raleigh W. Chiu
*Attorney, Agent, or Firm*—Rockey, Rifkin and Ryther

[57] ABSTRACT

A serpentine ramp is rotatable about a horizontal axis between its center and its upper end to lift a pinball from a lower play surface to an upper play surface. A ball is directed from the lower surface into a ball receiving portion in the lower end of the ramp. This closes an optical switch causing the ramp to rotate between a receiving position and a discharge position. A ball disposed in the receiving portion rolls on the ramp to its upper end and then onto the upper surface. A second optical switch is closed by the return of the ramp to the receiving position which terminates the operation of the device.

6 Claims, 2 Drawing Sheets

SERPENTINE RAMP FOR A PINBALL GAME

BACKGROUND OF THE INVENTION

This invention generally relates to pinball games and more particularly to play features used in pinball games which are designed to foster and to maintain player interest in the games. A typical pinball game includes an inclined playfield which supports a rolling ball, a pair of player controlled flippers, a vertical backbox and a variety of play features. The person who plays the game controls the flippers mounted on the playfield to keep the pinball in play.

A typical object of pinball games is for the player to direct pinballs at selected play features or targets on the playfield to score points or to achieve some predetermined game objective. Player interest in pinball games is increased by providing playfields which have multiple levels. Also, a player can increase the score by causing a ball to be transported between the levels by a skill shot. Accordingly, it is desirable to provide mechanisms by which pinballs can be transferred from a first to a second playfield level and to increase that player's score as a result of achieving the transfer.

SUMMARY OF THE INVENTION

According to the present invention, a serpentine ramp for raising a ball from a lower play surface to an upper play surface is provided. The serpentine ramp is rotated about a horizontal axis when a pinball is disposed in a receiving portion in the lower end of the ramp. An electric motor which is controlled by optical switches rotates the ramp via a linkage which causes the ramp to move between a ball receiving position and a discharge position where the lower end of the ramp is positioned above the upper end of the ramp. The rotation of the ramp causes a ball disposed in the receiving portion to roll on the ramp to its upper end and then onto the upper play surface.

DETAILED DESCRIPTION OF A PREFERRED EMBODIMENT

Figure 1:
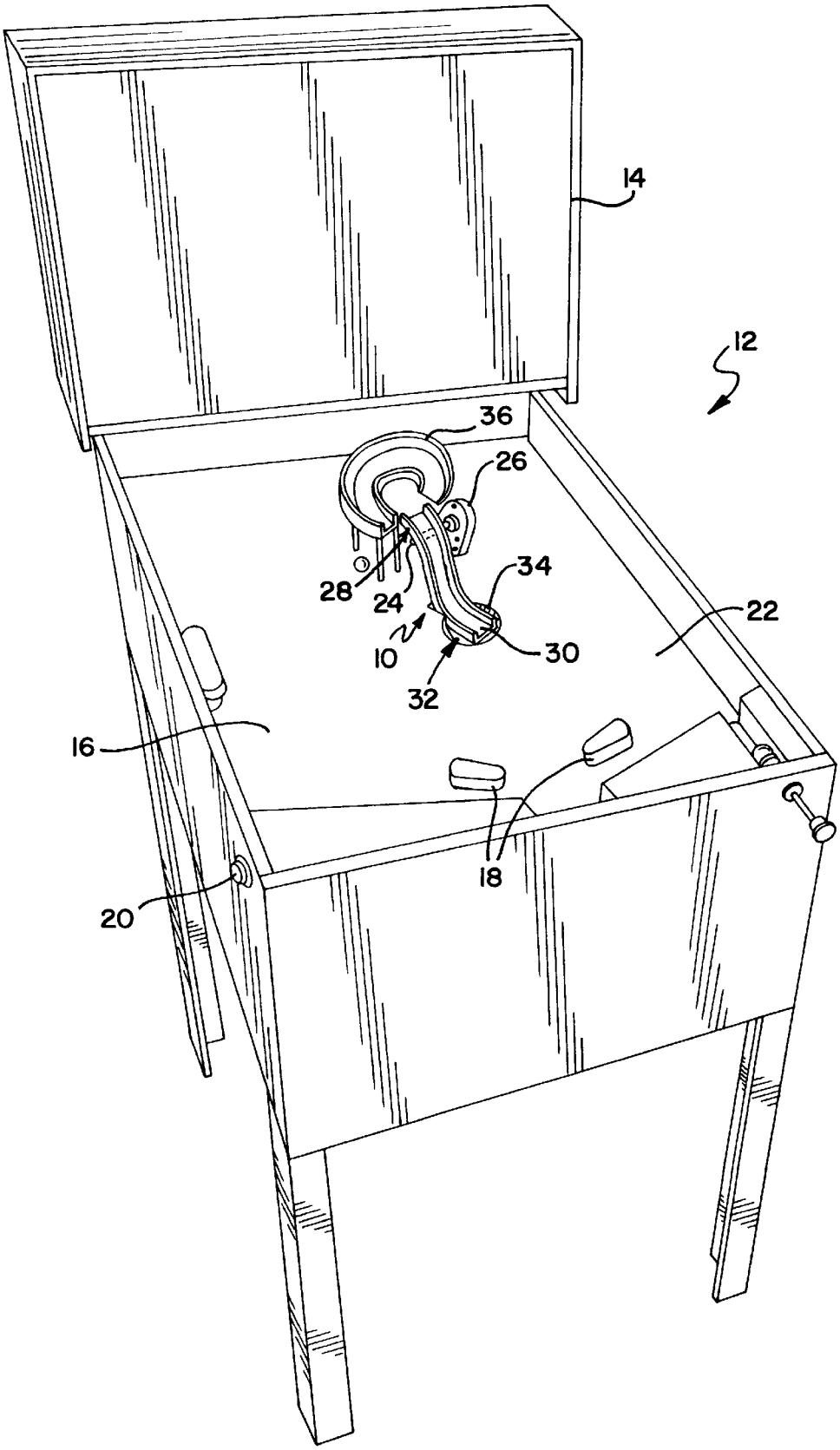
FIG. 1 is a perspective view of a pinball game which includes the serpentine ramp according to the present invention.

Referring to FIG. 1, a perspective view of the serpentine ramp 10 mounted on a pinball game 12 is illustrated. A typical pinball game 12 includes a vertical backbox 14, an inclined playfield 16, a pair of flippers 18, flipper control switches 20, shooter lane 22 (for introducing a ball onto the playfield) and a pinball which rolls about on the playfield 16. It must be noted, however, that in practice playfield 16 incorporates a number of other playfield features, the serpentine ramp 10 being the only feature shown for clarity.

The serpentine ramp 10 is mounted above the playfield 16 to ramp shaft 24 and gear box 26. The serpentine ramp 10 is rotatable about the horizontal axis of ramp shaft 24 and includes an upper end 28 and a receiving portion 30 in its lower end 32. Initially, the ramp 10 is in a ball receiving position wherein a pinball can be directed into the receiving portion 30 due to the ramp's lower end 32 being disposed below the playfield 16 in an aperture 34. Ramp 10 is rotated after a pinball is disposed in receiving portion 30.

In the embodiment of FIG. 1, the serpentine ramp 10 is horizontally rotated about the axis of shaft 24 to deliver a pinball from the playfield 16 to the playfield ramp 36. However, the serpentine ramp 10 can be utilized to deliver pinballs between different playfield surfaces, ramps, playfield levels or other playfield features.

Figure 2:
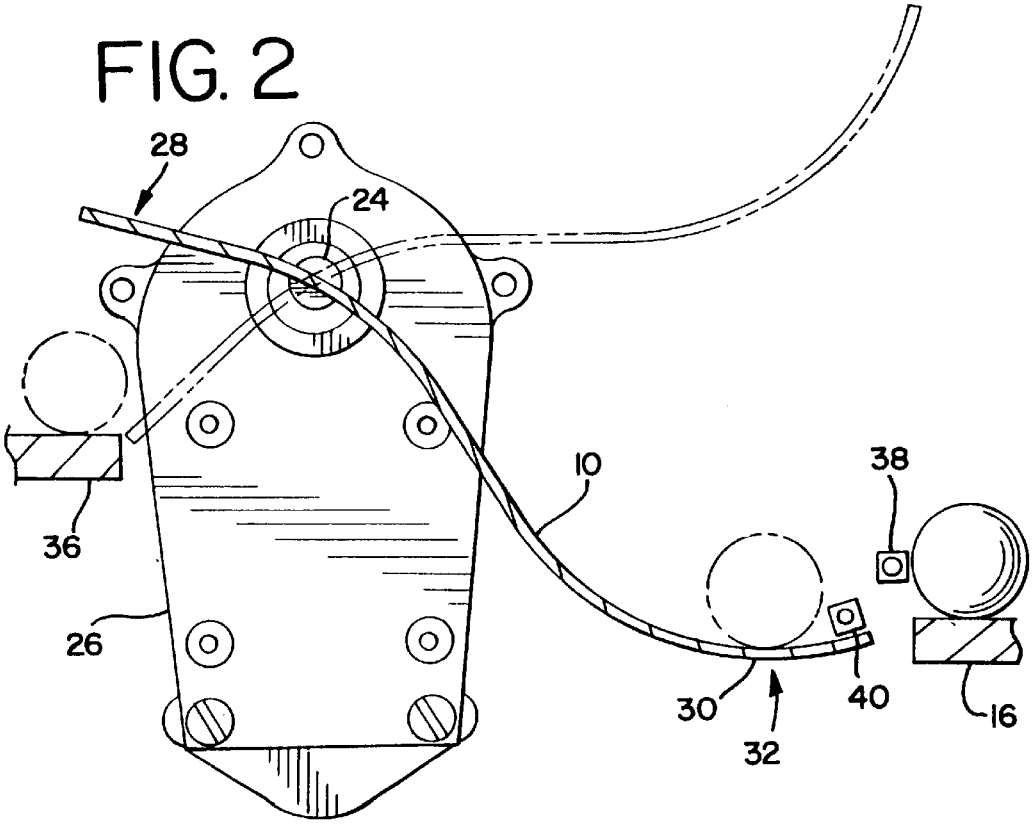
FIG. 2 is a front elevational view of the serpentine ramp of FIG. 1.

Referring now to FIG. 2, a side view of a serpentine ramp for 10 lifting a pinball from surface 16 to surface 36 is shown. Serpentine ramp 10 has lower and upper ends 32 and 28 respectively and is rotated about the shaft 24. The ramp 10 is capable of being rotated between two positions: a ball receiving position, illustrated in solid line in FIG. 2 wherein the receiving portion 30 is adjacent the playfield surface 16; and a discharge position, shown in phantom, wherein a pinball received in receiving portion 30 rolls on the ramp 10 to the playfield surface 36.

Positioned on the playfield 16 adjacent the aperture 34 is an optical switch 38 which generates a signal when a pinball enters the receiving portion 30. A second optical switch 40 is provided on the playfield surface 16 below switch 38 which detects when the serpentine ramp 10 returns to the ball receiving position as illustrated in solid line in FIG. 2.

Figure 3:
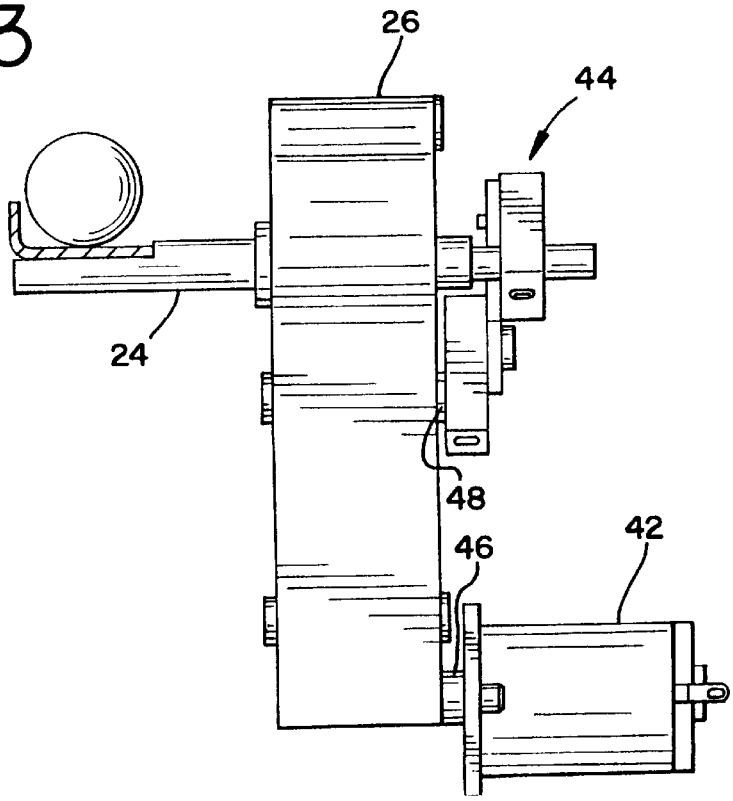
FIG. 3 is a side elevational view of the serpentine ramp of FIG. 1.

Referring to FIG. 3, a side elevational view of the serpentine ramp 10 is illustrated. A motor 42 drives a linkage assembly 44 via motor shaft 46, gear box 26 and gear shaft 48. The action of the linkage assembly 44 causes the ramp shaft 24 to rotate from the receiving position shown in dark line in FIG. 2 to the discharge position in phantom in FIG. 2 and back towards the receiving position.

Operation of the serpentine ramp 10 is as follows. During the course of game play, the player directs a pinball towards the receiving portion 30 which can be accomplished in a number of different ways. For example, a ball could be propelled towards the receiving portion 30 by a playfield shot using the flippers, by ricochet off of a solenoid kicker element or by being transported there by another play feature.

When a pinball is disposed in the receiving portion 30, it will have activated the optical switch 38. This sends a signal to the game microprocessor to turn on the motor 42 to rotate the serpentine ramp 10 from the ball receiving position. The rotation of the ramp 10 to the discharge position, as illustrated in phantom in FIG. 2, causes the pinball disposed in the receiving portion 30 to roll on the ramp 10 to the playfield surface 36.

Linkage assembly 44 is provided to rotate the ramp from the receiving position to a discharge position and back to the ball receiving position. Before the ramp returns to the ball receiving position, the ball received in the receiving portion 30 will have rolled off of the ramp and onto the playfield ramp 36. The return of the ramp 10 to the ball receiving position operates the optical switch 40 which generates a signal to the game microprocessor to shut off the motor 42.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A play feature for a pinball game for transporting a pinball from a lower play surface to an upper play surface comprising:

a serpentine ramp having lower and upper ends, said lower end having a pinball receiving portion thereon for receiving a pinball from said lower play surface; and means for rotating said ramp about a horizontal axis to raise the lower end to a position above said upper end to cause a pinball to roll along said ramp to said upper end, whereby a pinball received on the receiving portion rolls on the ramp to the upper end and is discharged onto the upper play surface as the ramp is rotated from a receiving position to a discharge position.

2. The play feature of claim 1 further comprising means for actuating said rotating means in response to a pinball being disposed on said receiving portion.

3. The play feature of claim 2 wherein said actuating means is an optical switch.

4. The play feature of claim 1 further comprising means for deactivating said rotating means when said ramp returns to said receiving position.

5. The play feature of claim 4 wherein said deactivating means is an optical switch.

6. The play feature of claim 1 wherein said means for rotating includes a gear assembly driven by a motor and a linkage assembly driven by said gear assembly for rotating the ramp between said receiving and discharge positions.

* * * * *